US006494734B1

(12) United States Patent
Shuey

(10) Patent No.: US 6,494,734 B1
(45) **Date of Patent: *Dec. 17, 2002**

(54) HIGH DENSITY ELECTRICAL CONNECTOR ASSEMBLY

(75) Inventor: Joseph B. Shuey, Camp Hill, PA (US)

(73) Assignee: FCI Americas Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 39 days.

(21) Appl. No.: 08/940,793

(22) Filed: Sep. 30, 1997

(51) Int. Cl.[7] ..... H01R 13/64

(52) U.S. Cl. ..... 439/378; 439/284; 439/717; 439/608

(58) Field of Search ..... 439/101, 108, 439/608, 701, 710, 717, 680, 681, 682, 284, 378

(56) References Cited

U.S. PATENT DOCUMENTS

| | | | | | |
|---|---|---|---|---|---|
| 3,950,059 | A | * | 4/1976 | Anhalt | 439/681 |
| 4,070,084 | A | | 1/1978 | Hutchison | 339/143 R |
| 4,148,545 | A | * | 4/1979 | Kies | 439/681 |
| 4,179,179 | A | * | 12/1979 | Lowden | 439/681 |
| 4,482,937 | A | | 11/1984 | Berg | 361/413 |
| 4,686,607 | A | | 8/1987 | Johnson | |
| 4,705,332 | A | | 11/1987 | Behzadi | 439/69 |
| 4,708,660 | A | * | 11/1987 | Claeys et al. | 439/284 |
| 4,806,107 | A | | 2/1989 | Arnold et al. | 439/79 |
| 4,836,791 | A | | 6/1989 | Grabbe et al. | 439/79 |
| 4,857,017 | A | | 8/1989 | Erk | 439/695 |
| 4,900,258 | A | | 2/1990 | Hnatuck et al. | 439/63 |
| 4,952,172 | A | | 8/1990 | Barkus et al. | 439/532 |
| 4,975,084 | A | * | 12/1990 | Fedder et al. | 439/108 |
| 5,030,108 | A | | 7/1991 | Babow et al. | 439/64 |
| 5,162,001 | A | * | 11/1992 | Harwath et al. | 439/108 |
| 5,306,171 | A | * | 4/1994 | Marshall | 439/284 |
| 5,342,211 | A | * | 8/1994 | Broeksteeg | 439/108 |
| 5,356,300 | A | * | 10/1994 | Costello et al. | 439/378 |
| 5,387,114 | A | | 2/1995 | Brunker et al. | 439/108 |
| 5,451,158 | A | | 9/1995 | Lin et al. | 439/79 |
| 5,454,733 | A | * | 10/1995 | Watanabe et al. | 439/701 |
| 5,486,115 | A | * | 1/1996 | Northey et al. | 439/108 |
| 5,490,787 | A | | 2/1996 | Bowman et al. | 439/79 |
| 5,507,655 | A | * | 4/1996 | Goerlich | 439/108 |
| 5,547,385 | A | * | 8/1996 | Spangler | 439/101 |

(List continued on next page.)

FOREIGN PATENT DOCUMENTS

| | | | |
|---|---|---|---|
| EP | 0 238 801 A1 | 9/1987 | |
| EP | 0 422 785 A2 | 4/1991 | |
| EP | 0 486 298 A1 | 5/1992 | |
| EP | 0 560 551 A1 | 9/1993 | ..... H01R/13/658 |
| EP | 0 739 064 A1 | 10/1996 | |
| WO | 96/34431 | 10/1996 | |

*Primary Examiner*—Tho D. Ta
*Assistant Examiner*—Briggitte R. Hammond
(74) *Attorney, Agent, or Firm*—Woodcock Washburn LLP

(57) ABSTRACT

A connector assembly includes a header and a receptacle adapted to mate with the header. The header comprises an insulative body and multiple-length contact pins arranged in columns. Tails connected to the contact pins are press fit or soldered to a printed circuit board or back plane such that tails of adjacent columns are offset by one-half pitch. The receptacle comprises a column of m contacts that extend through an insulative lead assembly and tails oriented at a right angle to the contacts that also extend through the insulative lead assembly. The tails are press fit or solder to a printed circuit board, such as a daughter board. The receptacles are adapted to be stacked together in n layers to form an m x n array of contacts that is housed within a receptacle housing.

19 Claims, 15 Drawing Sheets

U.S. PATENT DOCUMENTS 5,564,948 A 10/1996 Harting et al. ..... 439/607
5,575,663 A 11/1996 Broschard et al. ..... 439/79
5,584,709 A 12/1996 Kiat ..... 439/79
5,584,728 A * 12/1996 Cheng ..... 439/701
5,591,036 A 1/1997 Doi et al. ..... 439/79
5,593,307 A 1/1997 Bale et al. ..... 439/79
5,632,635 A 5/1997 Vanbesien et al. ..... 439/108
5,718,606 A * 2/1998 Rigby et al. ..... 439/108
5,803,768 A * 9/1998 Zell et al. ..... 439/108
5,863,223 A * 1/1999 Arnold ..... 439/717

* cited by examiner 10
12
13
14
16

10
12
13
14a
14b
14c
16
18

10
12
13
14
16
18

HIGH DENSITY ELECTRICAL CONNECTOR ASSEMBLY

The present invention relates generally to electrical connectors and more particularly, to a connector assembly comprising a receptacle and a header, having a high signal density and enhanced signal carrying capability.

BACKGROUND OF THE INVENTION

As electronic circuits and components become increasingly miniaturized, the demand for electrical connectors to electrically and mechanically interconnect a first PCB, such as a back panel or mother board, to a second PCB, such as a daughter board has also increased. As existing and additional components are enhanced or added to circuit boards, the electrical connectors that interconnect the circuit boards must accommodate the resulting additional connections. Further, as clock speeds increase other demands are being placed on the electrical connectors that interconnect circuit boards.

Typically, high density connectors have a signal density of 50–65 signals per inch of connector. Conventional techniques to increase signal density have been directed to minimizing the amount of space occupied by each receptacle or contact of the connector assembly. However, closely spaced electrical signals can interfere with one another. The interference phenomenon is referred to as "cross talk." Density and pin count are often viewed interchangeably, but there are important differences. Density refers to the number of contacts provided per unit length. In contrast, the number of contact elements that can reasonably withstand the mating and unmating forces is referred to as the pin count.

As more functions become integrated on semiconductor chips or on flexible circuit substrates and more chips are provided on printed circuit boards (PCBs), each PCB or flexible circuit must provide more inputs and outputs (I/Os). The demand for more I/Os directly translates to a demand for greater density. In addition, many system components are capable of operation at faster speeds than previously. Faster speed can result in the generation of potentially interfering signals, i.e., crosstalk and noise. The connectors used in such high-speed board-to-board, board-to-cable and cable-to-cable communications may be treated for design purposes like transmission lines in which crosstalk and noise become significant concerns. Indeed, the electrical performance of high-speed board-to-board, board-to-cable and cable-to-cable communications is dependent upon the amount of crosstalk and noise introduced at the connector interface.

One method of controlling cross talk is to connect certain terminals of the high density connector to grounded conductive areas of a printed circuit board. This solution is provided externally to the connector and provides for flexibility of design. In particular, a designer may configure the number of grounds and/or signals passed by the connector based on the particulars of the connections to the printed circuit board.

For example, U.S. Pat. No. 4,900,258, to Hnatuck et al., entitled "Multi-port Coaxial Printed Circuit Board Connector", discloses a connector having plural coaxial subassemblies. Each coaxial subassembly is provided with a center contact for passing a signal and an outer contact which is connected to ground. The individual coaxial subassemblies are arranged in rows and columns within the connector assembly which is then mounted at a right angle to a motherboard.

U.S. Pat. No. 5,547,385, to Spangler, entitled "Blind Mating Guides on Backwards Compatible Connector", discloses an electrical connector assembly comprising a first electrical connector having alignment posts which mate with receiving cavities provided in a second mating electrical connector. The ground contacts which extend from the first connector are longer than the signal contacts so the ground contacts engage respective conductors in the mating electrical connector prior to the signal contacts engaging their respective conductors in order to discharge electrostatic charge to a chassis ground.

According to another method of controlling cross talk, conductive material is disposed between rows and/or columns of signal carrying terminals in the high density connector. The conductive material is generally separated from the signal leads by a dielectric material such as plastic. According to this method, the conductive material is connected to a corresponding grounded conductive area of the printed circuit board. Such connectors have been termed in the art as strip-line or micro-strip connectors. Unlike the first method above, this solution is provided within the connector itself.

For example, U.S. Pat. No. 4,705,332, to Sadigh-Behzadi, entitled "High Density, Controlled Impedance Connectors", discloses a modular connector where discrete wafers having signal carrying conductors are stacked together. The discrete wafers are formed having multiple signal carrying contact elements which may be mounted at a right angle to a mother board or daughter board. Locating pins are provided, which are received by apertures in the mother board. Between each wafer is a planar ground element such that a strip line configuration is created.

U.S. Pat. No. 4,806,107, to Arnold et al., entitled "High Frequency Connector" discloses a strip line type connector having ground plates that extend from the connector. The ground plates are inserted into a complementary connector and are formed by bending single metal sheets into a U-shape. The extending portion of the U-shaped metal sheet form pairs of ground plates. A flexible connector attached near the base of the "U" is connected to a ground contact on a mother board.

U.S. Pat. No. 5,632,635, to VanBesien et al., entitled "Electrical Connector Array", discloses an electrical connector array having a plurality of signal contacts separated by a ground strip. The ground strip is provided with connection points which are spaced in an manner to minimally affect the particular routing of the connector.

In addition to the above-mentioned methods of controlling cross talk, the dielectric material used to separate conductive leads may affect cross talk by altering the characteristic impedance of the connector. Conventionally, non-conductive materials such as plastic are used as a dielectric to insulate regions between conductors within a connector.

For example, U.S. Pat. No. 4,070,048, to Hutchinson, entitled "Controlled Impedance Connector", discloses a connector for a computer backplane or printed circuit board where the signal carrying conductors are embedded in a dielectric block. A metallic foil is provided as a ground plane between rows of right angle pins. The metallic foil is connected with ground pins which are spaced apart in the connector assembly and are used as a reference to all signal carrying conductors and to obtain a desired impedance. Hutchinson also discloses embedding a flexible micro strip having signal carrying conductors and a ground plane within the dielectric block. Ground reference sockets, provided at each corner, are connected to the round plane on the micro strip.

While the prior art teaches connectors having a high pin count, the prior art connectors fails to teach a connector having a signal density which meets the demands of ever-increasing miniaturization of printed circuit boards. The prior art also fails to address increasing signal density by eliminating space consuming dielectric and insulative elements from the header array, such as plastic slots into which circuit cards are inserted. Moreover, the prior art fails to adequately address the problem of increased insertion forces that are generated and sequential mating concerns when a large number of header contacts are inserted into a receptacle. Still further, the prior art fails to teach a connector that uses air as a dielectric material to insulate signal leads while adequately reducing cross talk and maintaining a proper characteristic impedance.

SUMMARY OF THE INVENTION

In view of the above, the present invention, through one or more of its various aspects and/or embodiments is thus presented to accomplish one or more objects and advantages, such as those noted below.

A primary object of the present invention is to provide connector assemblies having a configuration characterized by enhanced signal carrying capacity, a low signal to ground ratio and preferably minimal cross talk, as required by the particular application for which the connector is intended.

The present invention provides a header, a receptacle, and a high density connector assembly comprising a combination of the receptacle and the header adapted to mate with each other. In accordance with an aspect of the present invention, a header for mating with a receptacle is provided which includes an insulative body comprising an outer surface and defining at least one notch, a plurality of tails extending through the insulative body, a guide pin integrally formed within the insulative body, and a plurality of conductive blades disposed on the outer surface of the insulative body, where each of the conductive pins being in electrical communication with one of the plurality of tails.

According to a feature of the present invention, the plurality of conductive blades are disposed in columns and at least three of the conductive blades are of unequal lengths. According to another feature, the at least three conductive blades are disposed in the columns such that adjacent conductive blades in each of the columns have different lengths.

According to yet another feature, each of the plurality of tails in a first column is aligned with a first edge of a corresponding conductive strip, and each of the plurality of tails in an adjacent column to the first column is aligned with a second edge of each of the conductive blades, the second edge being an opposite edge of the conductive strip with respect to the first edge.

According to a further feature, the at least one notch is provided at a corner of the insulative body.

According to a feature, the header further comprises a plurality of notches and a plurality of guide pins integrally formed within the insulative body.

According to another feature, the header is adapted to be joined on a printed circuit board to at least one other header. According to yet another feature, the joined headers may be mounted to opposing faces of a printed circuit board.

According to another aspect, a receptacle for mating with a header is provided which includes an insulative assembly frame, a plurality of pins extending through a first member of the insulative assembly frame, a plurality of tails extending through a second member of the insulative body, a plurality of leads connecting the plurality of pins to the plurality of tails, and a non-conductive protrusion extending from the second member of the insulative body.

According to a feature of the present invention, the first member and the second member are formed at a right angle.

According to another feature, the insulative member further comprises a base portion, a dimension of the base portion being defined by a distance the second member is offset from an edge of the first member.

According to yet another feature, a surface of the first member, through which the leads extend, is formed at a predetermined angle other than a right angle with respect to the second member. According to a feature, a surface of the first member, through which the leads extend, is formed at a right angle with respect to the second member.

According to another feature, the receptacle further comprises a diagonal member, the diagonal member extending from an end of the first member opposite the second member to an end of the second member opposite the first member.

According to yet another feature, the receptacle further comprises a third member, the third member disposed substantially parallel to the first member; and a fourth member, the fourth member disposed substantially parallel to the second member.

According to a further feature, a region of intersection of the first member and the second member has a cross section defining a triangular. According to yet another feature, a region of intersection of the first member and the second member has a cross section defining a semi-circular arc.

According to a further feature, the receptacle is adapted to be stacked with at least one other receptacle and the stacked receptacles may be mounted within a receptacle housing.

According to yet another aspect, a connector assembly is provided which includes the header and a receptacle housing containing at least one of the receptacles of the present invention. The receptacle housing and the header are adapted to be mated to each other, and each of the receptacle pins is adapted to mate with a corresponding one of the conductive blades when the receptacle housing and the header are mated.

According to a feature of the present invention, the conductive pins are disposed in columns on the outer member of the insulative body and at least two of the conductive pins in each of the columns having unequal lengths. The at least two conductive pins are disposed in the columns such that adjacent conductive pins in each column have different lengths.

According to another feature, the receptacle housing is adapted to mate with the header in accordance with a location of the guide pin.

According to yet another feature, the header is arranged as an array of plural headers having plural guide pins which provide for at least two points of guidance of the receptacle upon mating with the header.

According to still another feature, a plurality of notches and a plurality of guide pins are provided where the plurality of guide pins are aligned in a row.

According to a further feature, the receptacle housing is adapted to mate in an orientation parallel to the row of guide pins.

According to another feature, the header is arranged as an array of plural headers having plural guide pins which provide for at least two diagonally opposed points of guidance of the receptacle upon mating with the header.

According to yet another feature, the plurality of conductive pins and the plurality of terminals are arranged to have an interstitial ground pattern.

According to still another feature, a leading portion of each of the plurality of terminals is disposed within the receptacle housing, and a remaining portion of each of the plurality of terminals is external to the receptacle housing.

According to yet another feature, the header comprises a plurality of conductive pins arranged in parallel and the receptacle housing comprises a plurality of leads arranged in parallel, such that signal lead and ground lead connections between first and second printed circuit boards or back planes follow substantially parallel paths.

According to a further feature, an edge of one of the leads is arranged to be proximate to an edge of an adjacent lead, and a distance separating edges of the leads in the connector assembly is less than a thickness of the leads.

According to another aspect of the present invention, a header adapted to be mounted on opposing sides of a printed circuit board is provided which comprises an insulative body comprising an outer surface, a plurality of tails extending through the insulative body, and a plurality of conductive pins disposed on the outer surface of the insulative body where each of the conductive pins being in electrical communication with one of the plurality of tails. A plurality of tails of a first header, mounted to a first side of the printed circuit board, are fixed within corresponding holes in the printed circuit board, and a plurality of tails of a second header, mounted to second side of the printed circuit board, are fixed within the corresponding holes in the printed circuit board.

Other features of the invention are described below.

BRIEF DESCRIPTION OF THE DRAWINGS

The present invention is further described in the detailed description that follows, by reference to the noted plurality of drawings by way of non-limiting examples of preferred embodiments of the present invention, in which like references numerals represent similar parts throughout the several views of the drawings, and wherein.

DETAILED DESCRIPTION OF PREFERRED EMBODIMENTS

Figure 1A:
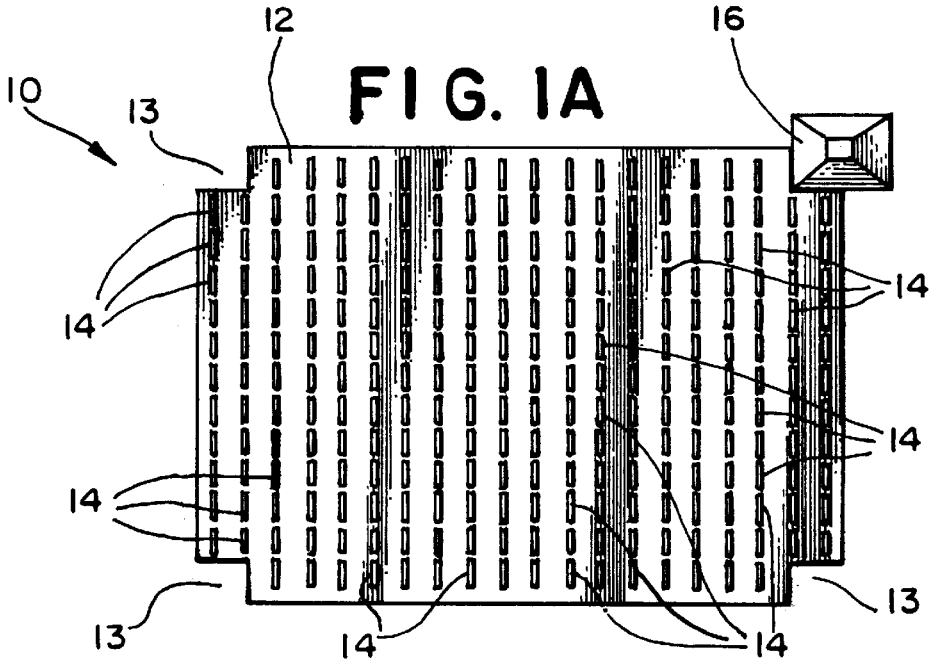
FIGS. 1A, 1B and 1C illustrate a top view, front side view and a side view of an exemplary embodiment of a header in accordance with the present invention.
Figure 1B:
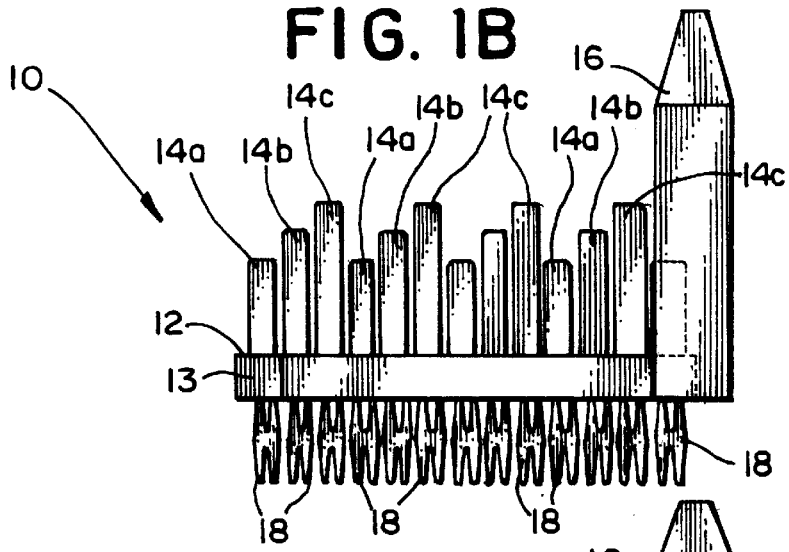
Figure 1C:
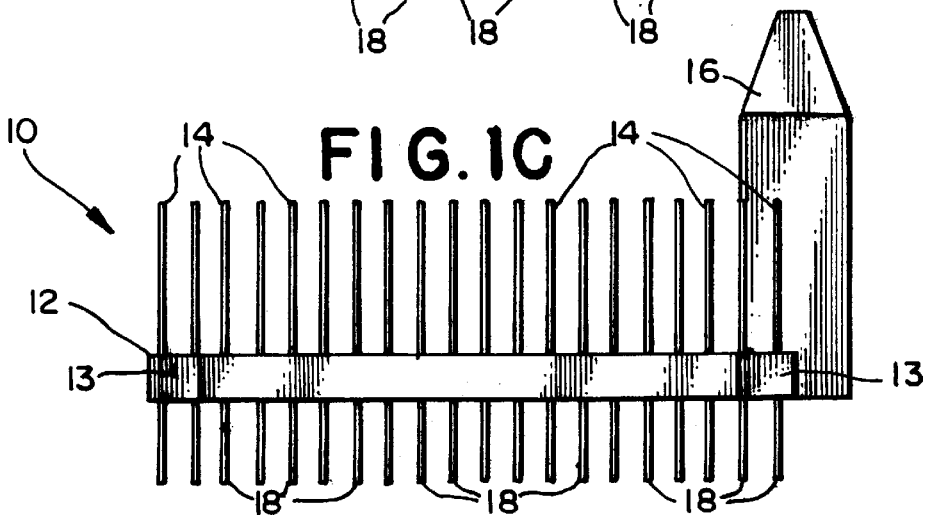

An embodiment of a header 10 in accordance with the present invention is depicted in FIGS. 1A–1C. As shown in the Figures, the header 10 comprises an insulative body portion 12 and header pins 14 which extend substantially in parallel from one side of the body portion 12. The header pins 14 may be arranged, for example, in eighteen columns of thirteen pins (18×13) and four columns of eleven pins (4×11) for a total of 278 pins. The present invention is not limited to such an arrangement and the header pins 14 may be arranged in other configurations. Compliant tails 18 are connected to the header pins 14 and extend from the other side of the body portion 12. The compliant tails 18 are, for example, press fit to a back plane printed wire board (PWB) or other printed circuit board (PCB) (to be discussed with reference to FIG. 3).

The body portion 12 is provided with notched regions 13, into which a guide pin 16 is integrally formed. As shown in FIG. 1A, a guide pin 16 may be provided at one corner of the header 10. Although the guide pin 16 is shown in the upper right-hand corner of the body portion 12 in FIG. 1A, the guide pin 16 may be provided in any of notched regions 13.

In a preferred embodiment, each row of header pins 14 comprises staged header pins 14*a*, 14*a* and 14*a* having differing lengths. As illustrated in the example of FIG. 1B, the length of header pins 14*a*, 14*a* and 14*a* increases by a predetermined amount h (e.g., 1 mm). Although the arrangement of FIG. 1B shows groups of three header pins (e.g., 14*a*, 14*a* and 14*c*) offset by a constant amount h, other groupings of header pins may be provided, such as groups of two, four, etc. pins varied by a constant or variable amount. The staged header pins provides for a reduction of the insertion force, and smoother insertion into a receptacle. Further, the staged header pins provides for sequential mating of header pins (e.g,. sequentially mating ground leads followed by power leads and signal contacts) into the receptacle in order to minimize the probability of faults which may be caused upon insertion of the receptacle.

The header 10 is preferably used as part of connector having a 1:1 signal-to-ground ratio, where the signal and ground pins are arranged in a "checkerboard" pattern. Such an arrangement minimizes cross talk by appropriately surrounding each header pins connected to a signal by header pins connected to ground. In addition, the complaint tails in adjacent columns are preferably offset to opposite edges of their respective header pins comprising each column.

Figure 2A:
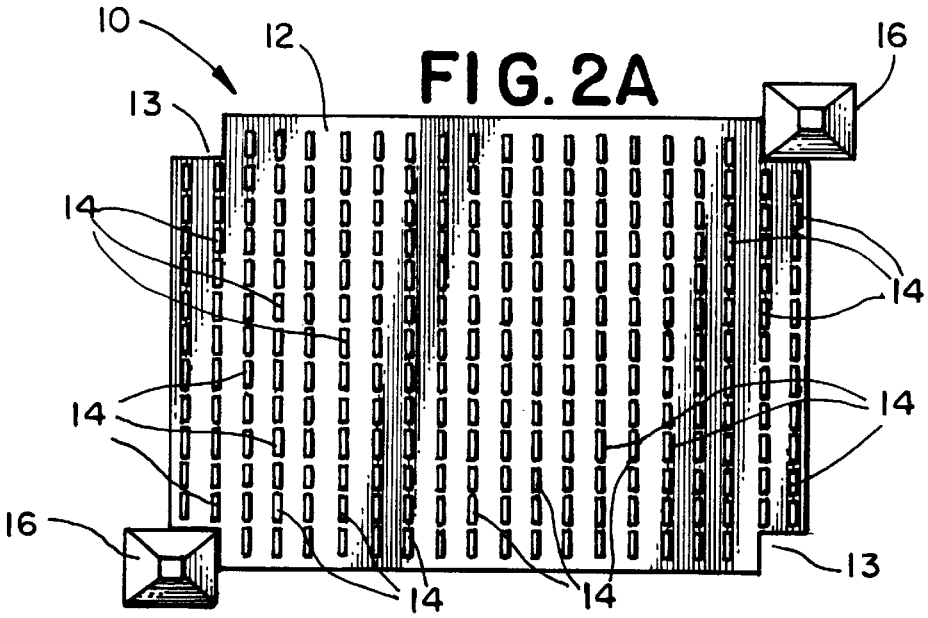
FIGS. 2A, 2B and 2C illustrate a top view, front side view and a side view of a second exemplary embodiment of a header in accordance with the present invention.
Figure 2B:
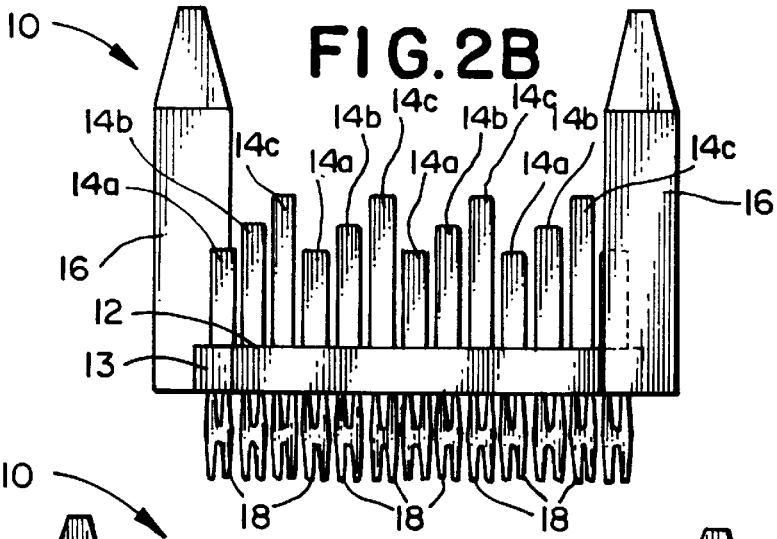
Figure 2C:
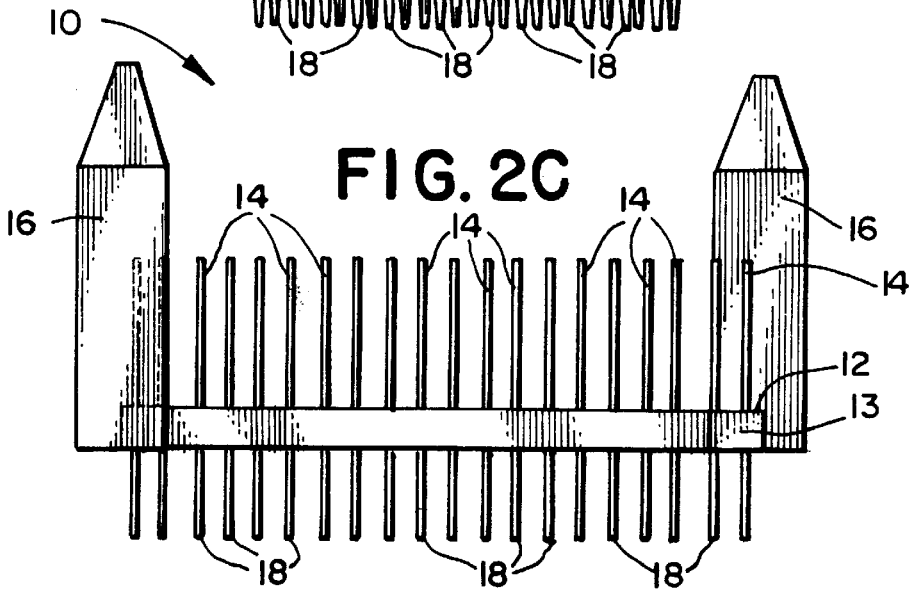

An alternative embodiment of the header 10 is shown in FIG. 2. In the embodiment of FIG. 2, two guide pins 16 are integrally formed in the insulative body 12. As illustrated, the guide pins 16 are provided at diagonally opposing corners. Those skilled in the art will appreciate that the guide pins 16 may alternatively be provided at opposing corners on the same side of the insulative body 12.

Figure 3A:
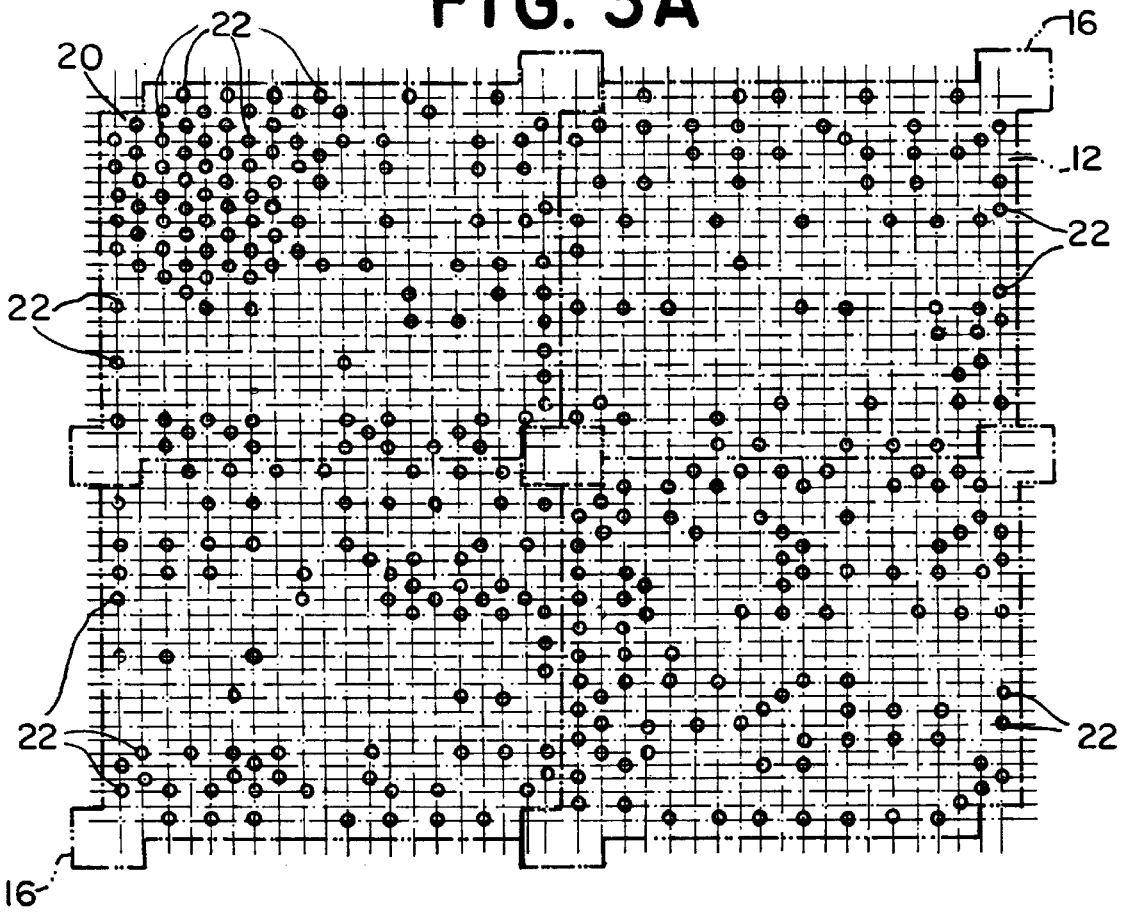
FIGS. 3A, 3B, 3C and 3D illustrate an exemplary hole pattern and interlayer race pattern of the back plane to which the header of the present invention is mounted.
Figure 3B:
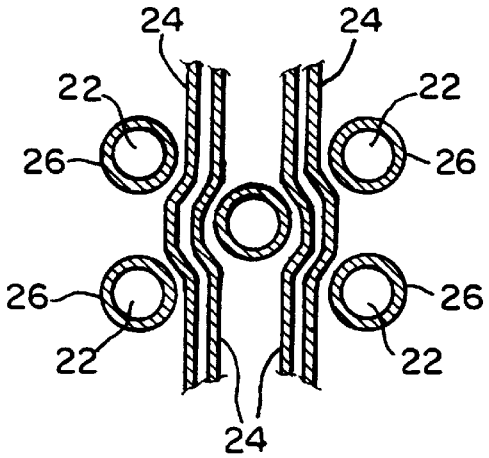

FIGS. 3A and 3B illustrate an exemplary layout of the back plane or PCB 20 to which the header 10 of the present invention is connected. Holes 22 are drilled into the PCB 20 having a predetermined diameter (e.g., 0.57 mm) and are plated by plating 26 to provide a surrounding conductive region. Adjacent columns of holes 22 are offset by one-half pitch in order to increased signal carrying capacity of the back plane or PCB 20. Traces 24 are etched into the PCB 20 having a predetermined thickness and separation (e.g., 0.127 mm), and are routed between the holes 22 to optimize the signal carry capacity of the PCB 20. The compliant tails 18 of the header 10 are press fit into the holes 22 to be placed in electrical contact with the plating 26.

Figure 13:
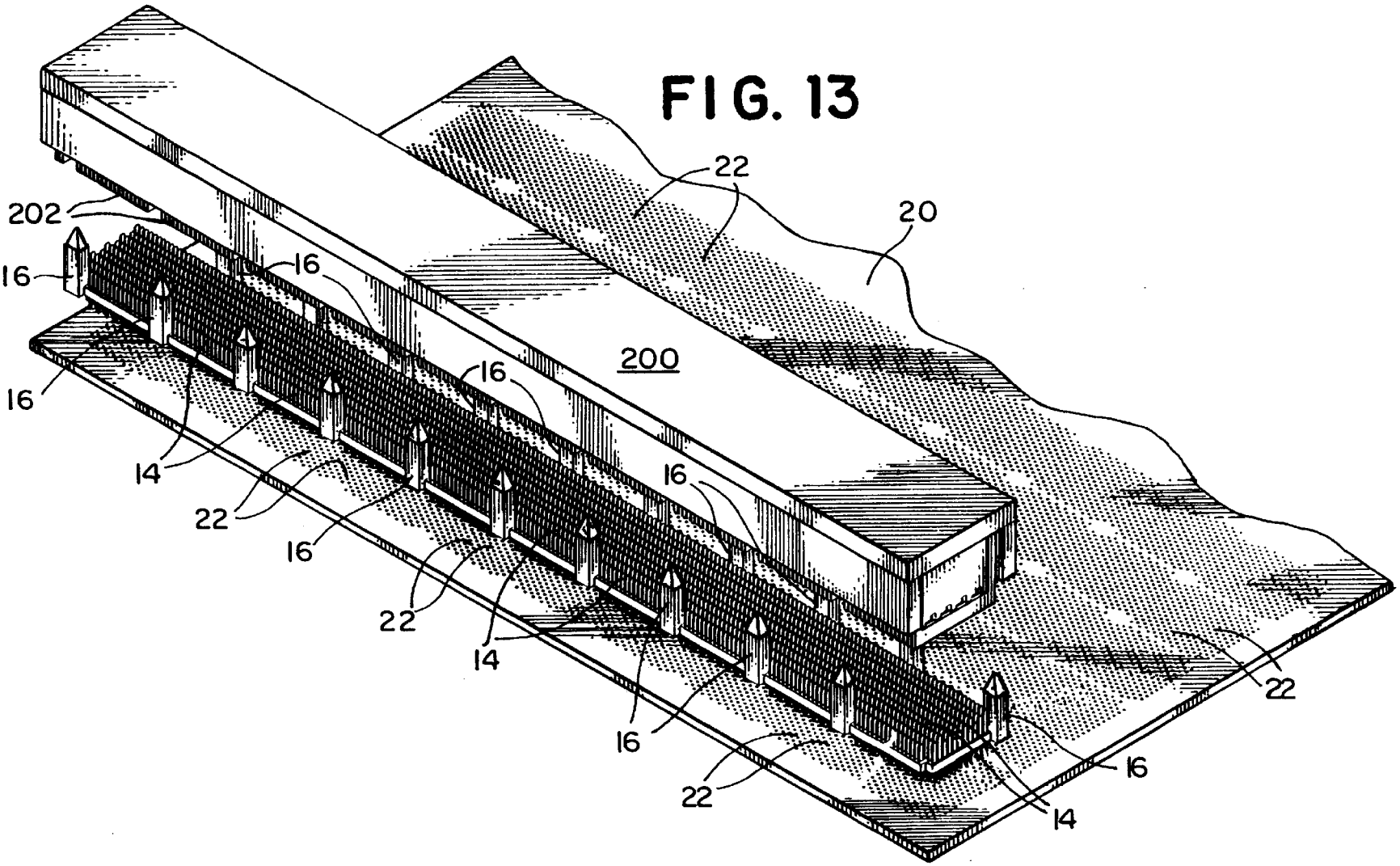
FIG. 13 illustrates a perspective view of a press fit tool for press fitting the header into a back plane.

FIG. 13 illustrates an exemplary press fit insertion tool for press fitting a plurality headers 10 into the printed circuit board 20. The press insertion tool 200 comprises n array of slots 202 into which the header pins 14 of the header 10 are inserted. After inserting the header pins 14 into the slots 202, the tails 18 can be press fit into their corresponding holes 22 by a user applying a downward force on the press insertion tool 200 toward the PCB 20.

Figure 3C:
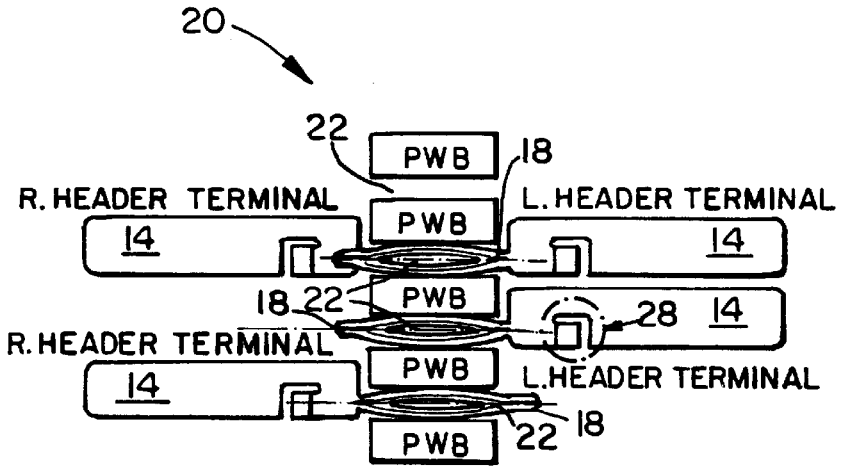
Figure 3D:
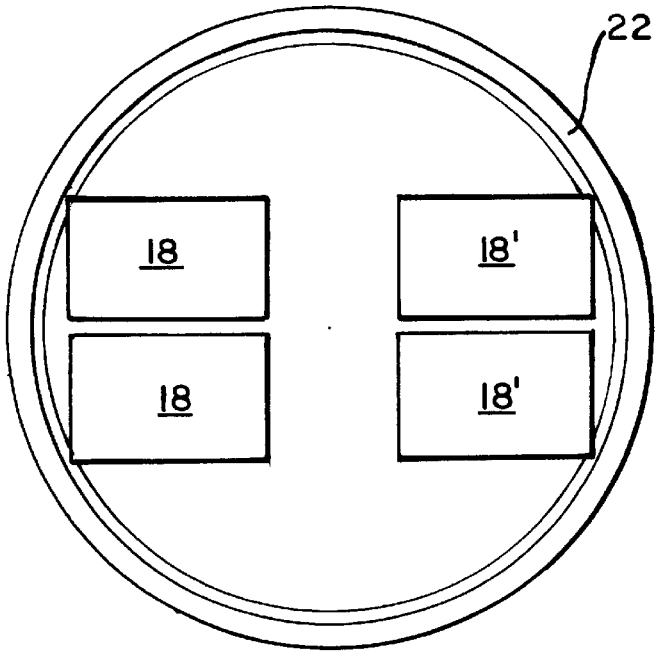

According to an aspect of the present invention, and as shown in FIGS. 3C and 3D, headers may be mounted on opposite sides of the PCB 20 by inserting their respective tails 18 and 18' into the same holes 22. As shown, right and left headers having tails 18 and 18' are insert into a hole 22. Such an insertion may be achieved for as many holes 22 as necessary. A retention mechanism 28 is provided to attach the header pin with the insulative body (not shown). This design is particularly suited for mid-plane applications.

Figure 4:
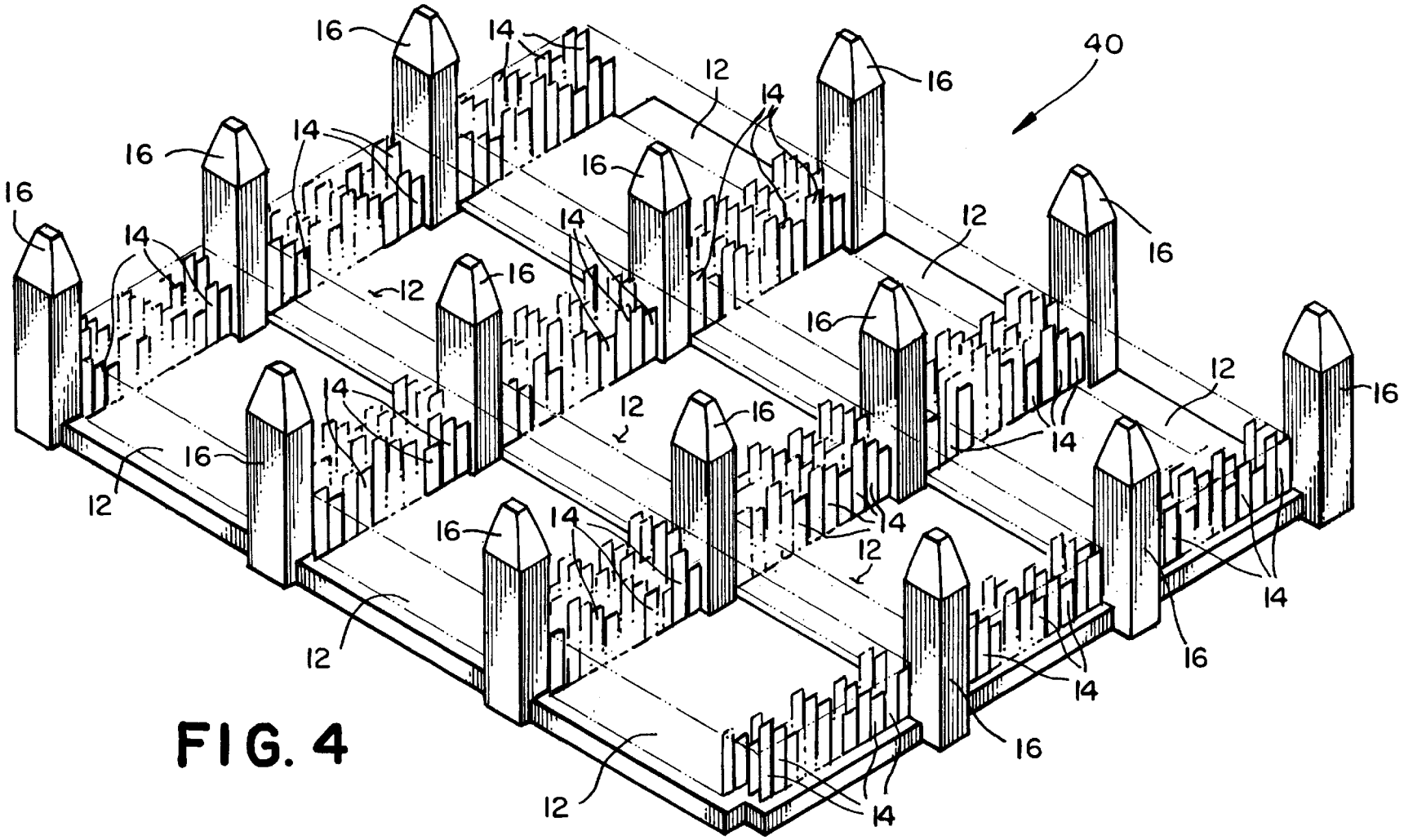
FIG. 4 illustrates an exemplary header assembly in accordance with the present invention.

Referring to FIG. 4, a plurality of headers 10 may be arranged as a high density array (HDA) header assembly 40. The high density assembly 40 comprises a plurality of headers 10 mounted together on, for example, a PCB (not shown) to form the high density array. For reasons of clarity, all of the header pins 14 are not shown in the Figure. As shown, the guide pins 16 align to form "slots" in the high density assembly 40. Receptacles may be inserted into the "slots" to form a connection with the header array 40. The header array 40 of the present invention does not require conventional slots and provides for a higher density connector by eliminating the need for space consuming insulative walls used to form conventional slots on the printed circuit board.

Figure 5A:
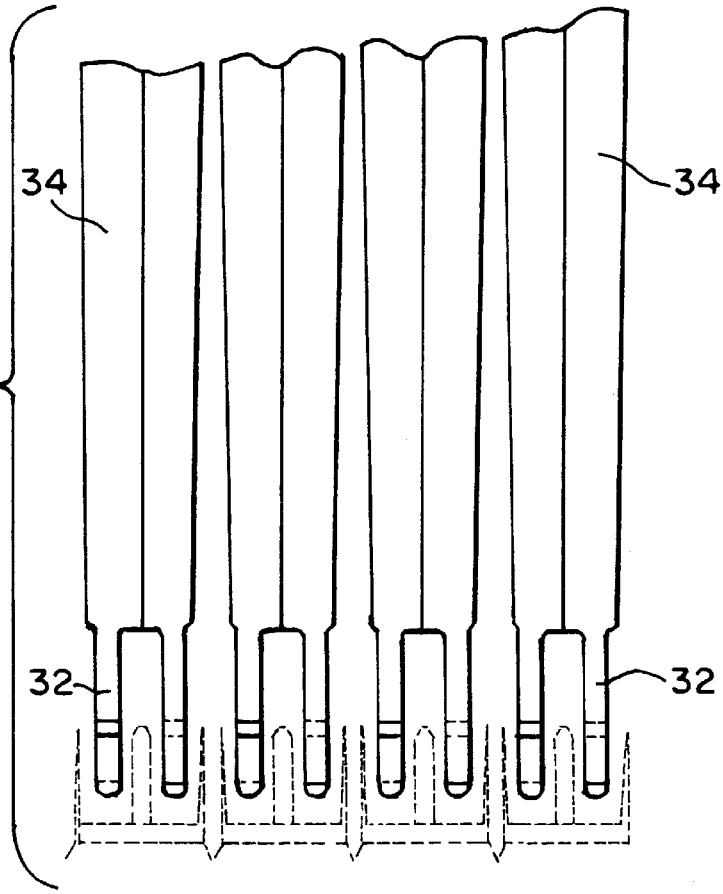
FIGS. 5A, 5B, 5C, 5D and 5E illustrates a receptacle terminal in accordance with the present invention.
Figure 5B:
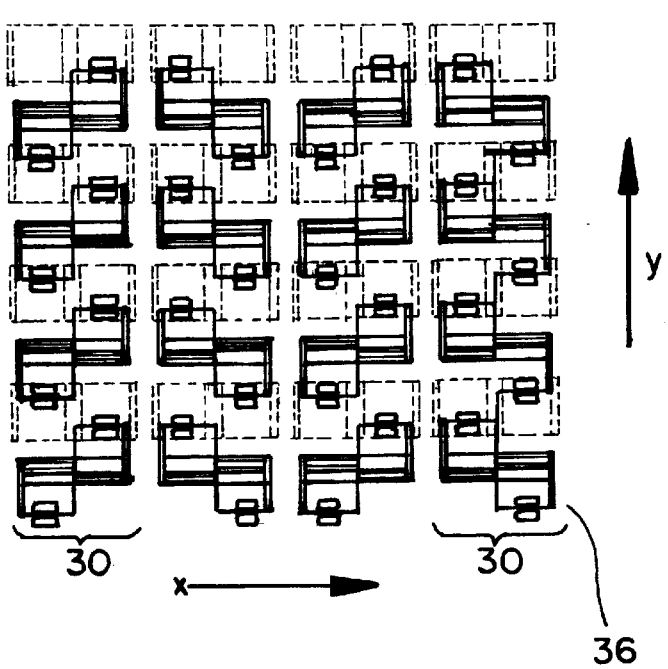

FIGS. 5A–5E illustrate a partial view of a housing 36 in accordance with the present invention. The receptacle housing 36 includes a receptacle 30 and terminals 32 which are stamped from conductive leads 34. As shown in FIG. 5A, two terminals 32 are stamped from each lead 34, and are disposed adjacent to one another in the x-direction. Further, the two terminals 32 are stamped as mirror images of each other (see FIG. 5C), such that one terminal 32 is offset with respect to the other terminal 32 about an insertion axis of the header pin 14 into an insertion opening 38. FIG. 5B illustrates that the orientation of the offset between adjacent terminals 32 in the x-direction is alternated within the housing 36. It is noted that in the preferred embodiment, air is used as the dielectric material between adjacent terminals 32.

Figure 5C:
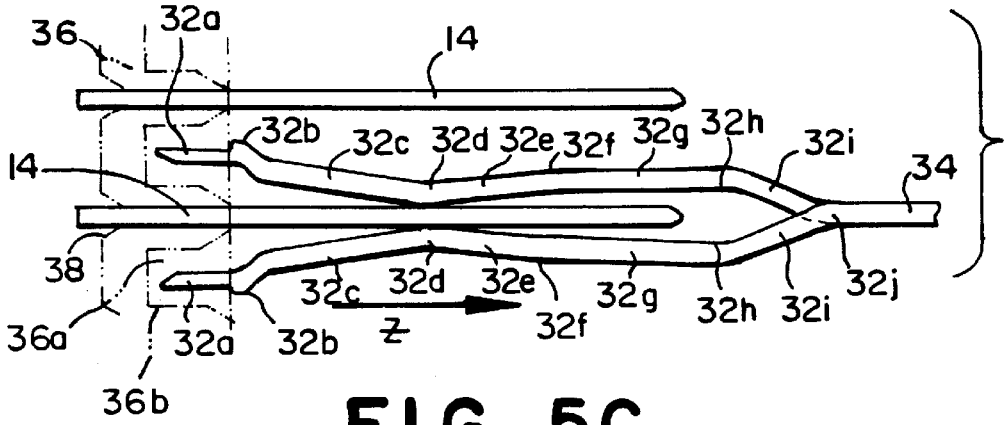
Figure 5D:
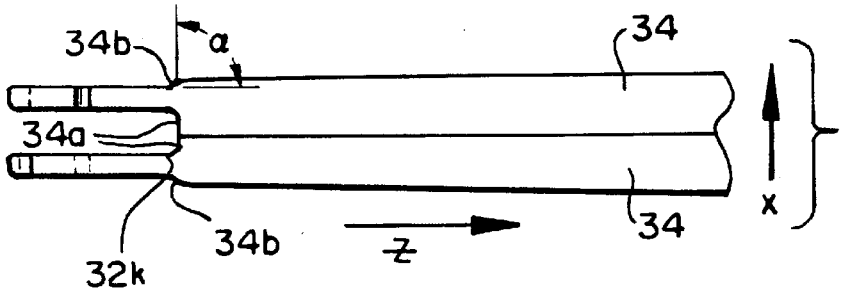
Figure 5E:
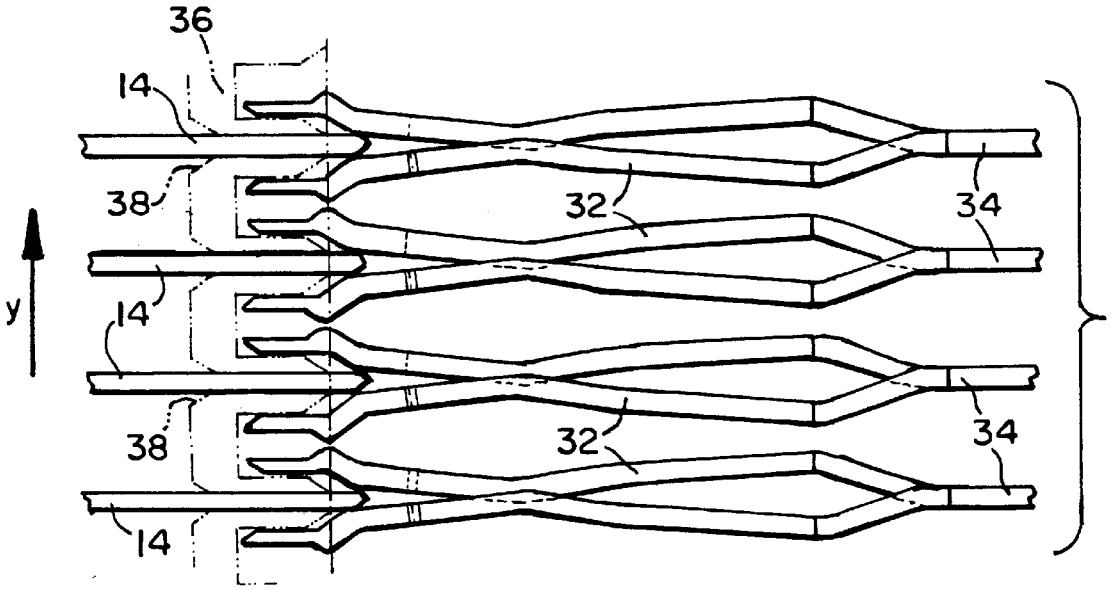

As shown in the FIGS. 5C and 5E, the terminal 32 may be stamped as a plurality of discrete portions from the lead 34. A leading portion 32*a* extends from an elbow 32*b*. The leading portion 32*a* of terminal 32 is contained within a hollow area 36*a* of the housing 36 and rests on an edge 36*b*. In a preferred embodiment, the leading portion 32*a* is the only portion of the terminal 32 which contacts the housing 36. The elbow 32*b* meets a first portion 32*c* which joins a second portion 32*e* at first bend 32*d*. The second portion 32*e* meets a third portion 32*g* at second bend 32*f*. The third portion 32*g* meets a fourth portion 32*i* at third bend 32*h*. The fourth portion 32*i* bends at fourth bend 32*j* to meet the lead 34. This above mentioned structure advantageously provides for a long throat area (i.e., the space between leads 32) into which the header pins 14 of two or more lengths may be inserted. Further, the long throat area advantageously reduces insertion force.

As best illustrated by the top view of the terminal 32 in FIG. 5D, the width of the lead 34 tapers moving toward the terminal end. From the point identified by reference numeral 32*k*, the inner portion of lead 34 between the two extending rectangular portions is stamped to form a straight edge 34*a*. The outer portions of lead 34 at point 32*k* are stamped to form an angled edge 34*a* having a predetermined angle $\alpha$ with respect to the z-axis. The two extending portions shown in the figure form a section of the first portion 32*c*, the elbow 32*b* and the leading portion 32*a*.

FIGS. 5C and 5E also illustrate insertion of the header pin 14 into the terminals 32. FIG. 5E shows the header pin 14 partially inserted, whereas FIG. 5C shows the header pin 14 in a more fully inserted state. When the header pin 14 is inserted into insertion opening 38, the header pin 14 initially contacts first portion 32*c* (FIG. 5E), which creates a force in the y-direction, thereby moving the terminal 32 in the y-direction. As the terminal 32 is moved in the y-direction, the leading portions 32*a* are lifted from the edge 36*b* and move within the hollow area 36*a*. As the header pin 14 is further inserted into the insertion opening 38, the header pin 14 contacts first bend 32*d* and is held in place under the resilient force created by the terminal 32 in the y-direction.

Figure 6B:
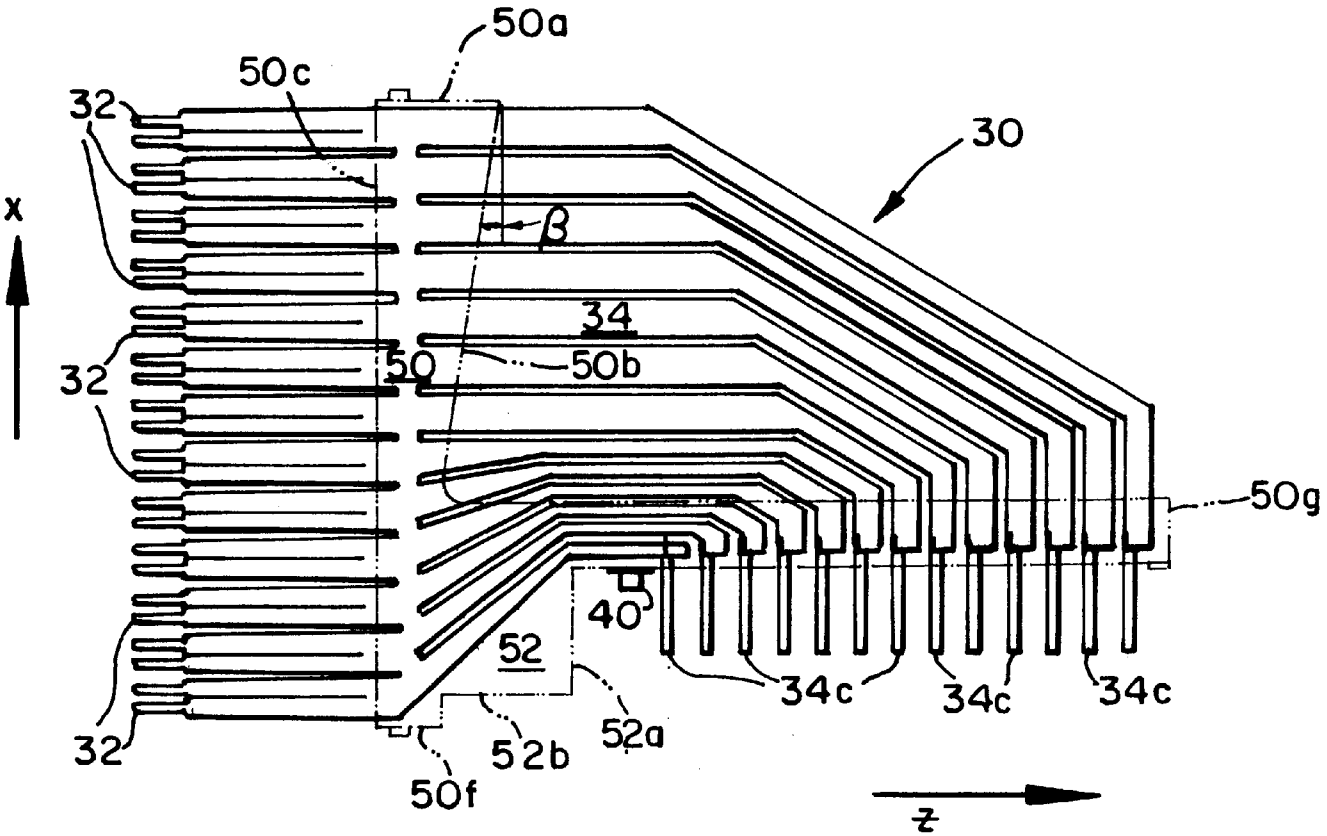
FIGS. 6A and 6B illustrate a receptacle as an exemplary insert molded lead assembly inserted into a housing.
Figure 6A:
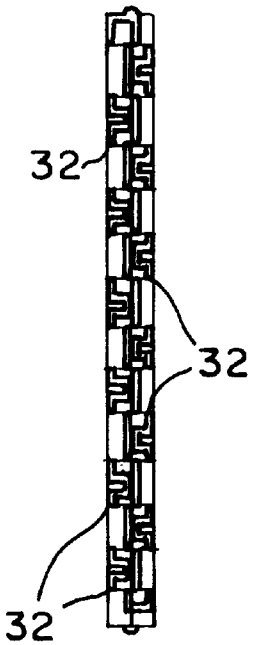

FIGS. 6A and 6B illustrate an embodiment of a lead assembly in accordance with the present invention. The lead assembly 50 has a generally L-shaped cross-section which includes first member 50*a* and second member 50*g*. Side 50*b* tapers at an angle $\beta$ in the x-direction from the top edge of first member 50*a* toward side 50*c*. The second member 50*g* is formed offset in the x-direction from a base portion 50*f* of the receptacle 50. The offset creates a rectangular region 52 adjacent to the second member 50*g* having sides 52*a* and 52*b* and is provide for mating with a PCB (not shown). A plastic peg 40 is provided to absorb mating forces generated when the lead assembly is inserted into a printed circuit board. Leads 34 meet member 50*g* such that receptacle tails 34*a* extend therefrom. The receptacle tails 34*c* are press fit or soldered to the printed circuit board. As shown, the leads 34 are bent in such a manner so that the receptacle tails 34*a* extend at a right angle with respect to terminals 32. As more clearly shown in FIG. 6A, the lead assembly 50 contains a singled column of terminals 32.

Further, as shown by FIGS. 5B, 5E and 6B, the leads 34 of the receptacle are in parallel from the terminal 36 to the tail 34*c*. The parallel leads 34 generally have a thickness of 0.03 inches and are separated by smaller distance (e.g., 0.01 inches) which maintains the edges of ground leads in close proximity to the signal leads within the receptacle. Further, because the header 10 includes pins 14 extending substantially in parallel, when the receptacle 30 is mated to the header 10, the signal and ground connections between printed circuit boards and/or back planes are coupled along parallel paths throughout the entirety of the connection. Such a configuration provides a dense connector wherein the ground leads are in close proximity to each signal lead to further minimize cross talk without substantially changing the impedance.

In accordance with a feature of the present invention, a plurality of lead assemblies may be stacked together to form an m×n array of terminals where m is the number of terminals 32 provided on each lead assembly (e.g., 13 pins), and n is the number of lead assemblies stacked together (e.g,. 20 lead assemblies). The stacked lead assemblies are placed within the housing 36 to form a receptacle assembly.

Such an arrangement of lead assemblies will be described below with reference to FIGS. 7A, 8A, 9A and 10A.

Figure 7A:
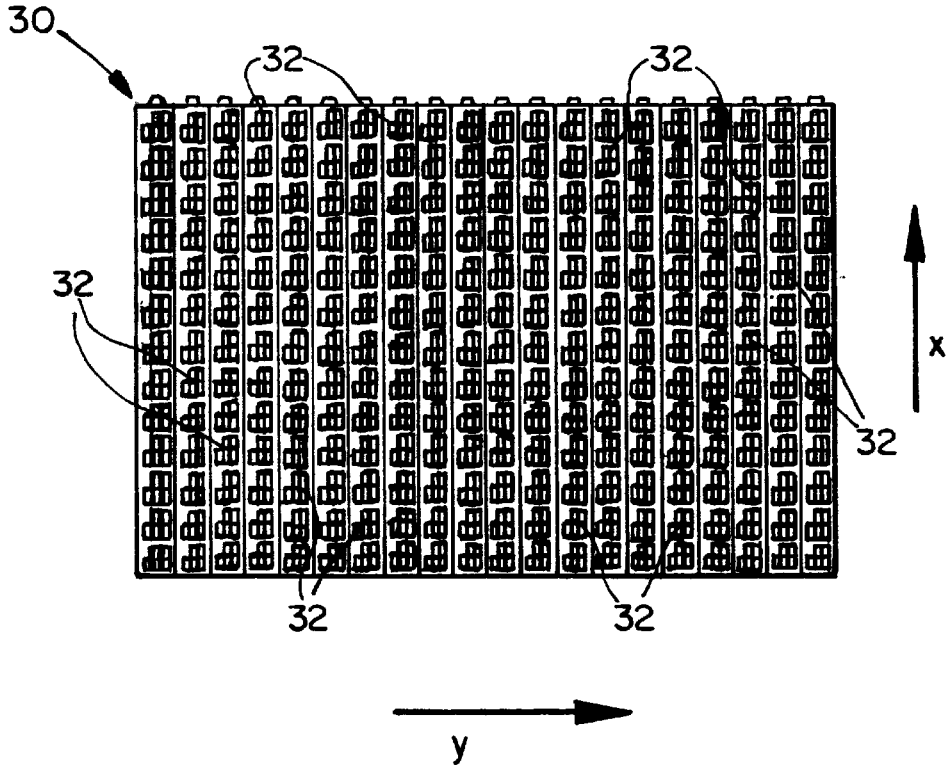
FIGS. 7A, 7B, 8A, 8B, 9A, 9B, 10A and 10B illustrate exemplary embodiments of the molded lead assembly of the present invention.
Figure 7B:
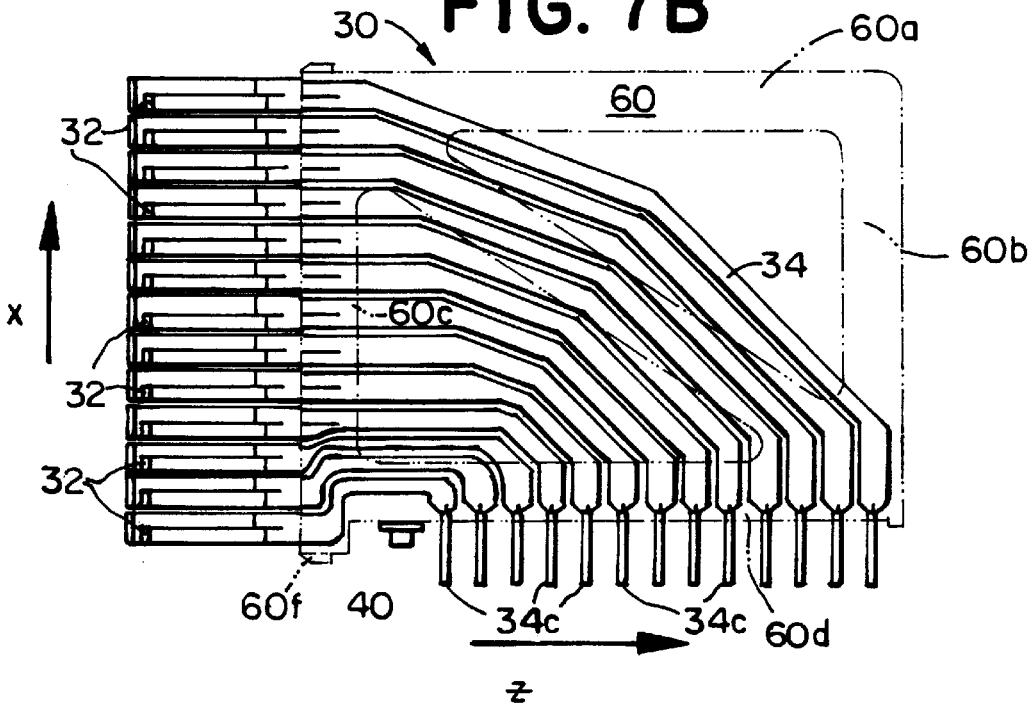

FIGS. 7A and 7B illustrate another embodiment of the lead assembly. In this embodiment, the lead assembly 60 has a rectangular cross-section having top and bottom member 60*a* and 60*d*, respectively, and side members 60*c* and 60*d*. A diagonal cross member 60*e* is also provided. In addition, the side member 60*d* is offset from base portion 60*f* by a predetermined amount for mating to a PCB (not shown). A plastic peg 40 is provided to absorb mating forces with a printed circuit board. The leads 34 meet the member 60*d* such that the receptacle tails 34*a* extend therefrom. The receptacle tails 34*a* are press fit or soldered to the printed circuit board. As shown, the leads 34 are bent such that the receptacle tails 34*a* extend at a right angle with respect to the terminals 32. The lead assembly 60 contains a single column of terminals 32. FIG. 7A illustrates an exemplary 13×20 array of stacked lead assemblies 60.

Figure 8A:
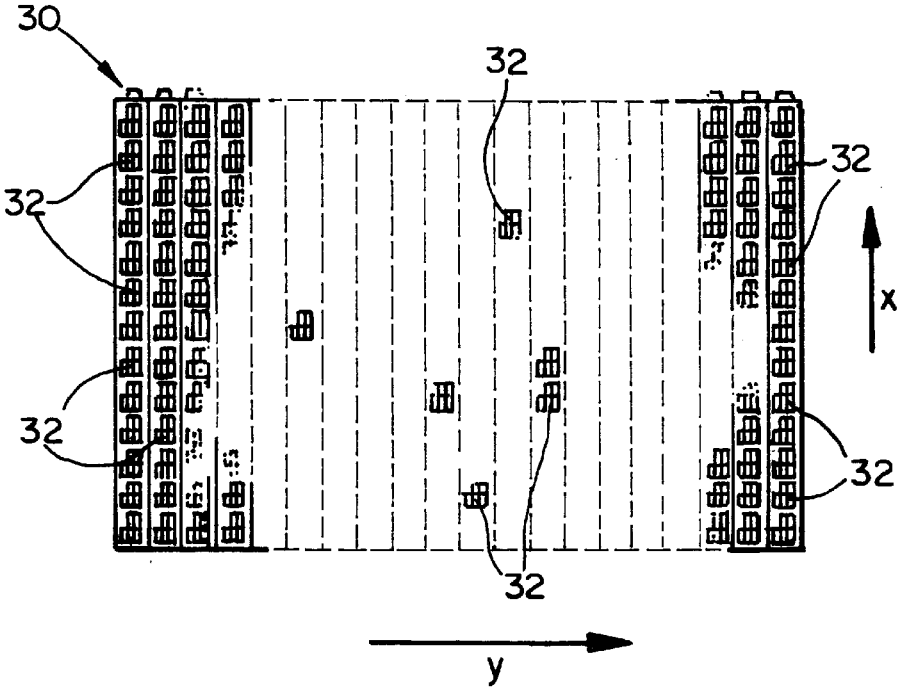
Figure 8B:
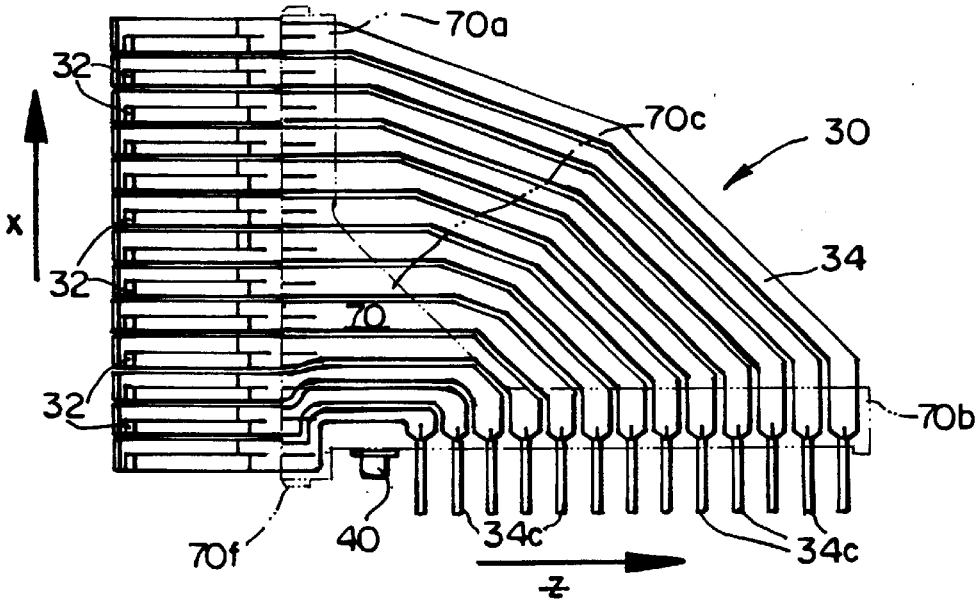

FIGS. 8A and 8B illustrate yet another embodiment of the lead assembly. In this embodiment, the lead assembly 70 has a L-shaped cross-section having perpendicular members 70*a* and 70*b*. As illustrated member 70*a* widens near base 70*f* to form triangular portion 70*c* which joins member 70*a* to member 70*b*. The member 70*b* is offset from the base portion 70*f* by a predetermined amount for mating with a PCB (not shown). To absorb mating forces, a plastic peg 40 is also provided. The leads 34 meet the member 70*b* such that the receptacle tails 34*a* extend therefrom. The receptacle tails 34*a* are press fit or soldered to a printed circuit board. As shown, the leads 34 are bent such that the receptacle tails 34*a* extend at a right angle with respect to the terminals 32. The lead assembly 70 contains a single column of terminals 32. FIG. 8A illustrates an exemplary 13×20 array of stacked lead assemblies 70.

Figure 9A:
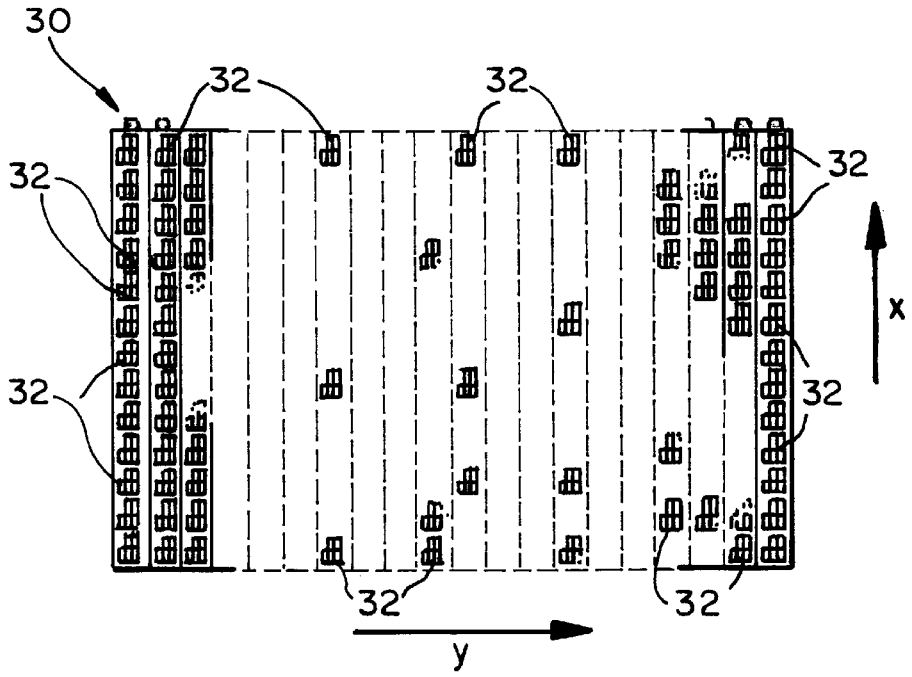
Figure 9B:
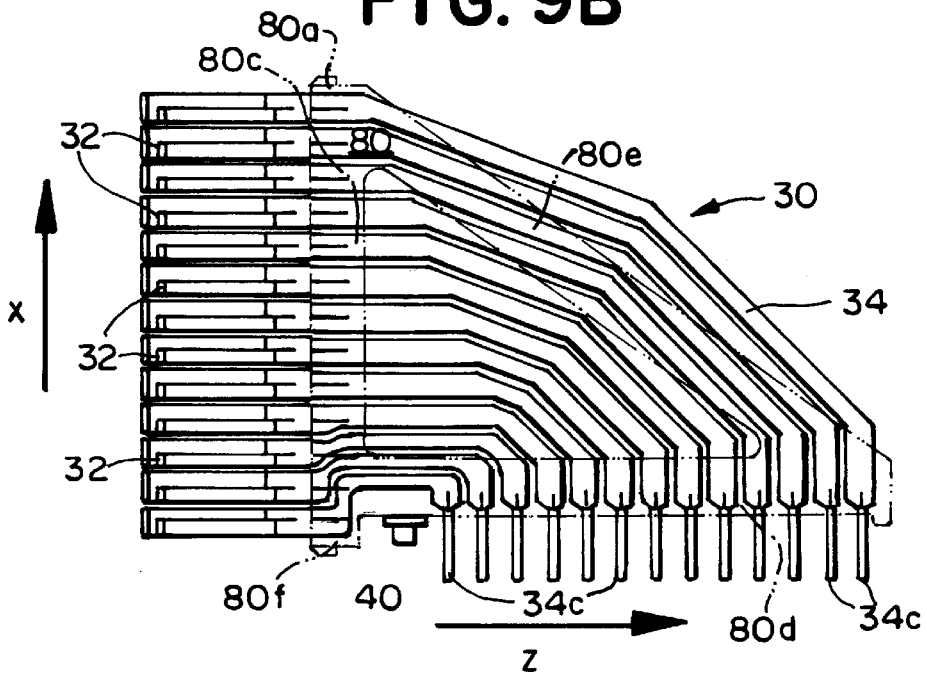

FIGS. 9A and 9B illustrate a further embodiment of the lead assembly. In this embodiment, the lead assembly 80 has a rectangular cross-section having top and bottom members 80*a* and 80*d*, respectively, and a diagonal cross member 80*e*. In addition, the side member 80*d* is offset from base portion 80*f* by a predetermined amount form mating with a PCB (not shown). A plastic peg 40 is also provided to absorb mating forces. The leads 34 meet the member 80*d* such that the receptacle tails 34*a* extend therefrom. The receptacle tails 34*a* are press fit or soldered to the printed circuit board. As shown, the leads 34 are bent such that the receptacle tails 34*a* extend at a right angle with respect to the terminals 32. The lead assembly 80 contains a single column of terminals 32. FIG. 9A illustrates an exemplary 13×20 array of stacked lead assemblies 80.

Figure 10A:
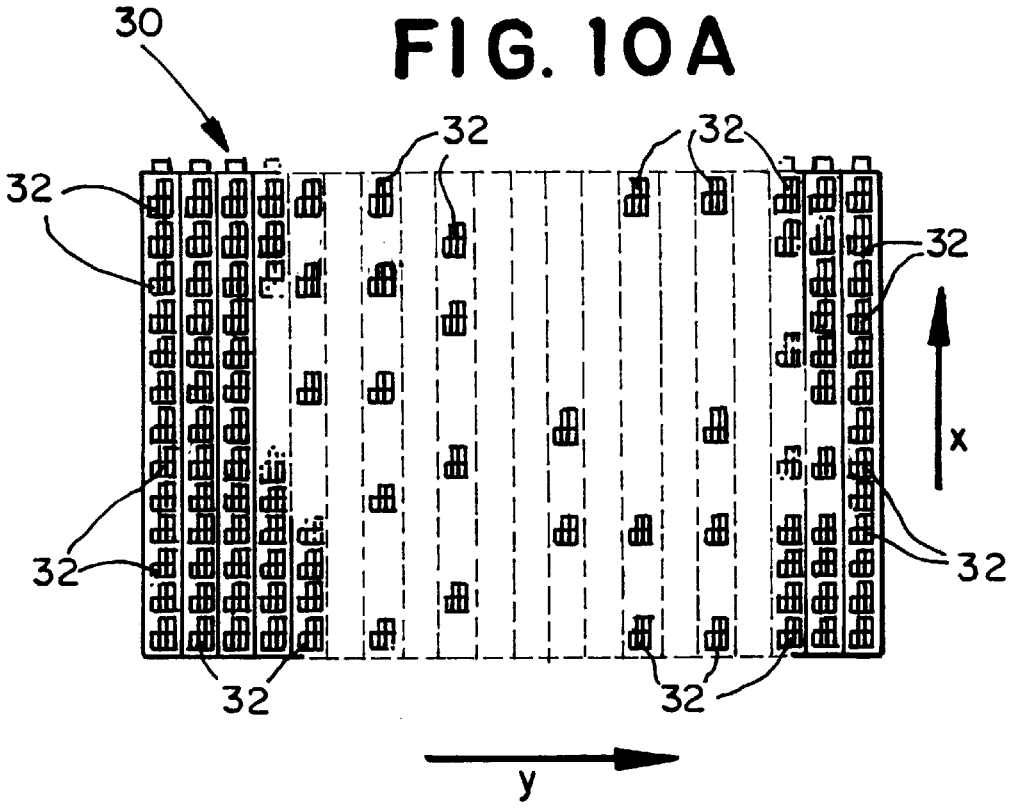
Figure 10B:
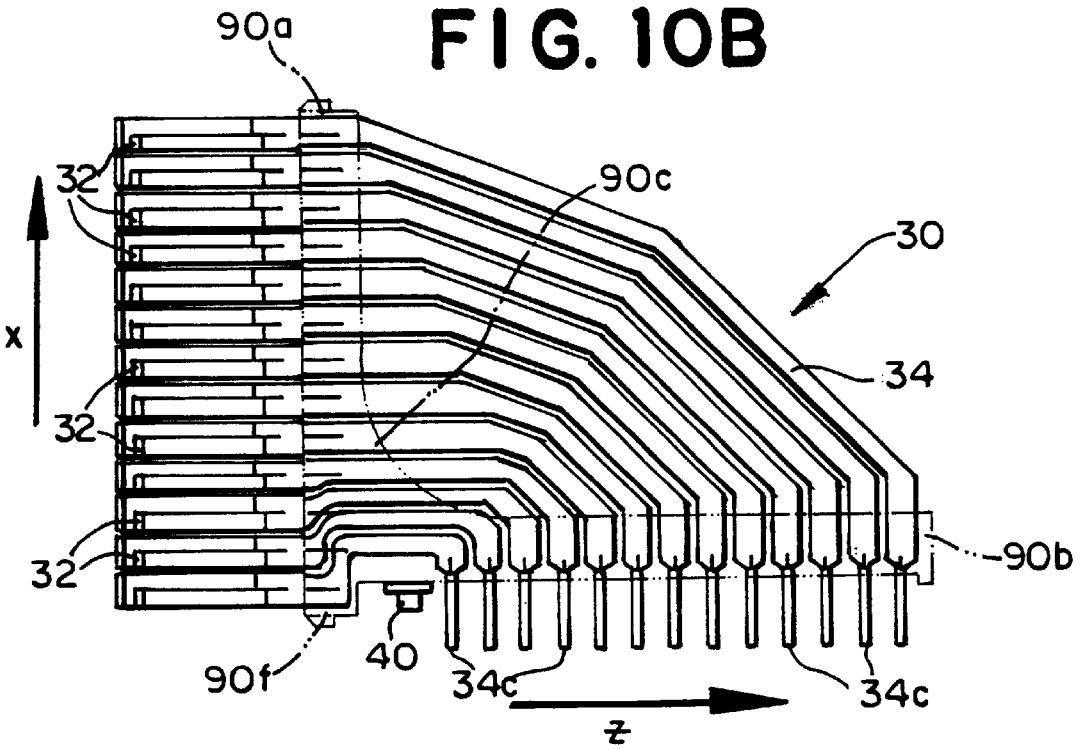
Figure 11A:
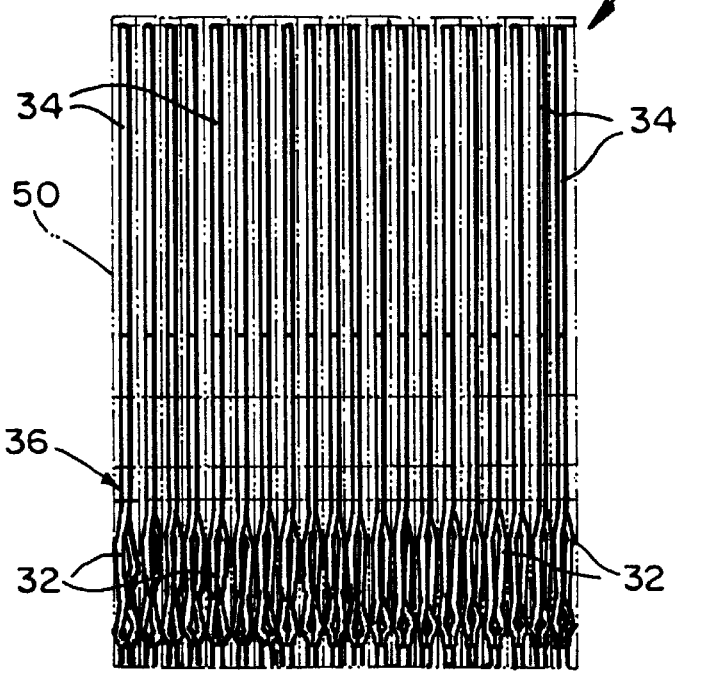
FIGS. 11A, 11B, 11C and 11D illustrate an exemplary receptacle connector assembly in accordance with the present invention imbedded in an assembly.
Figure 11B:
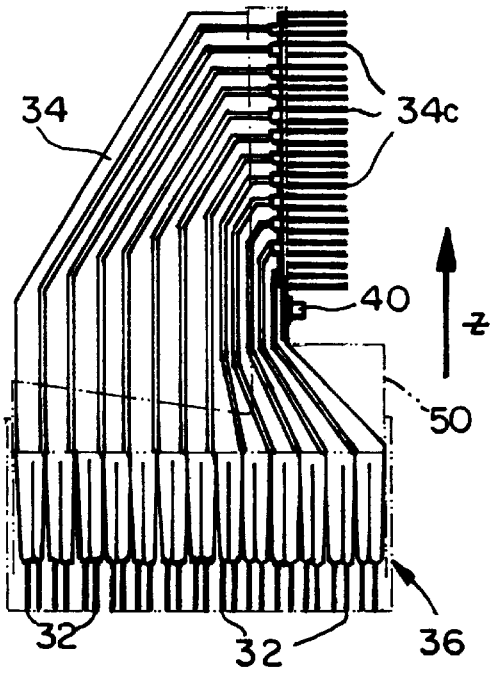
Figure 11D:
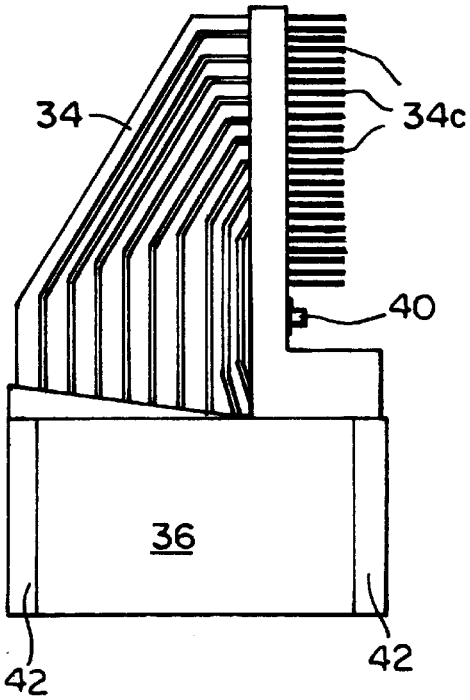
Figure 11C:
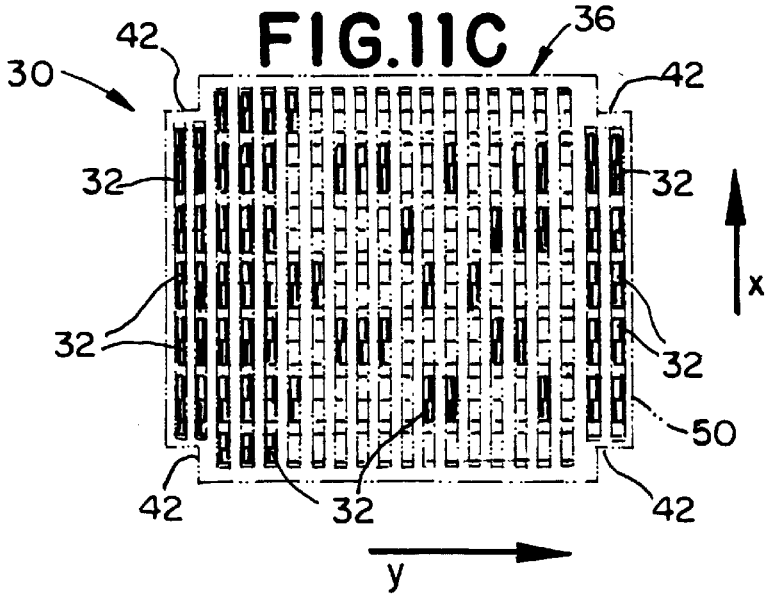

FIGS. 10A and 10B illustrate another embodiment of the lead assembly of the present invention. In this embodiment, the lead assembly 90 has a L-shaped cross-section having perpendicular members 90*a* and 90*b*. As illustrated, member 90*a* widens near base 90*f* to form semi-circular arc portion 90*c* which joins member 90*a* to member 90*b*. Member 90*b* is offset from the base portion 90*f* by a predetermined amount for mating with a PCB (not shown). A plastic peg 40 is provided to absorb mating forces generated upon insertion of the receptacle into a printed circuit board. The leads 34 meet the member 90*b* such that the receptacle tails 34*a* extend therefrom. The receptacle tails 34*a* are press fit or soldered to the printed circuit board. As shown, the leads 34 are bent such that the receptacle tails 34*c* extend at a right angle with respect to the terminals 32. The lead assembly 90 contains a single column of terminals 32. FIG. 10A illustrates an exemplary 13×20 array of stacked lead assemblies 90.

As noted above, the lead assemblies of the present invention may be stacked together to form an array of terminals within the housing 36 of the receptacle 30. Referring to FIGS. 11A–11D, the lead frames are inserted and secured into the housing 36. The leading portion 32*a* of the terminals 32 are placed into the hollow areas 36*a* between the insertion slots 38 of the housing 36, as noted above (see FIGS. 5C and 5E). The remaining portion of terminals 32 and leads 34 are exposed to air. As shown, the leads 34 are bent such that the receptacle tails 34*a* extend at a right angle with respect to terminals 32. Notched regions 42 are provided in the housing 36 to receive the guide pins 16. The lead assemblies are arranged in the housing 36 to receive the header pins 14 of the header 10. For example, the lead assemblies may be stacked within the housing 36 so that the terminals 32 are arranged in eighteen columns of thirteen terminals (18×13) and four columns of eleven terminals (4×11) for a total of 278 terminals to mate with the header of FIG. 1.

Figure 12A:
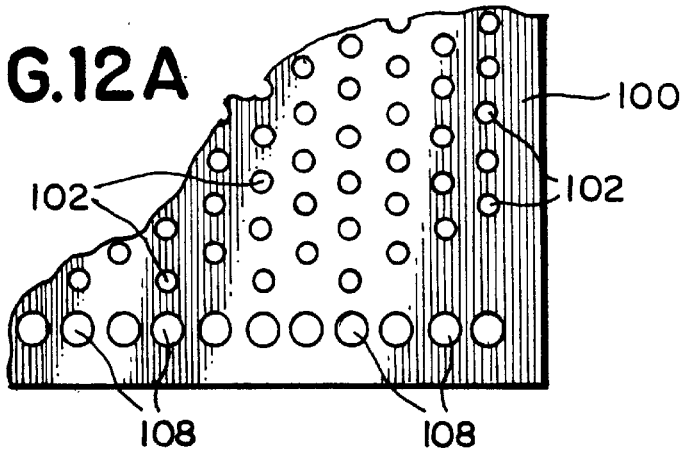
FIGS. 12A and 12B illustrate an exemplary hole pattern and trace routing pattern of a printed circuit board to which the receptacle of the present invention is mounted.
Figure 12B:
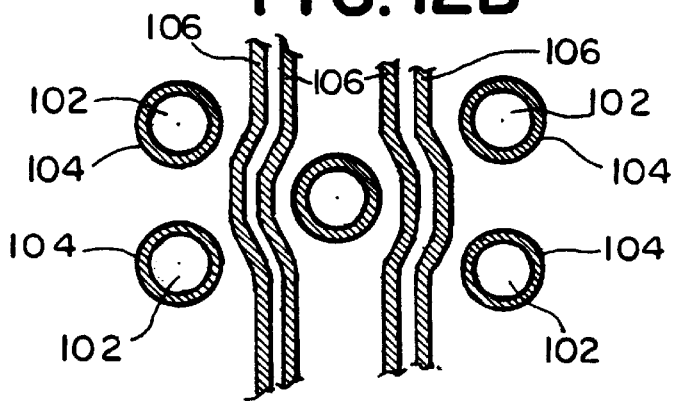

FIGS. 12A and 12B illustrate an exemplary layout of the daughter board or PCB 100 that receives the receptacle housing 36 and lead assemblies of the present invention.

Holes 102 are drilled into the PCB 100 having a predetermined diameter (e.g., 0.51 mm) and are plated by plating 104 to provide a conductive region. Traces 106 are etching into the PCB 100 having a predetermined thickness and separation (e.g., 0.127 mm) and are routed between columns of holes 102. The receptacle tails 34*a* are press fit into the holes 102 to be placed in electrical contact the plating 104. As shown in FIG. 12, adjacent columns of holes 102 are offset by one-half pitch. The receptacle tails 34*a* of the receptacle 30 may be attached to the daughter board by soldering or press fitting. The plastic peg 40, provided to absorb insertion forces as the receptacle housing 36 is mated to the daughter board, is inserted into holes 108 having a diameter of, for example, 0.65 mm.

The parts referred to throughout this specification can be made from known materials used to make similar conventional parts. For example, the insulative housings can be made of various plastics, such as polyetherimide resin or polyphenylene sulfide resin. The conductive walls, bases, and shields can be made of any nonmagnetic metal or metal alloy including zinc, aluminum, copper, brass or alloys thereof. The contact elements of the present invention can be made from any suitable metal used for electrical terminals, such as brass, phosphor bronze, beryllium copper and the like. The contact elements may be plated or coated with a conductive layer, such as tin, nickel, palladium, gold, silver or a suitable alloy.

It is noted that the foregoing examples have been provided merely for the purpose of explanation and are in no way to be construed as limiting of the present invention. While the invention has been described with reference to preferred embodiments, it is understood that the words which have been used herein are words of description and illustration, rather than words of limitations. Changes may be made without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto. For example, the present invention is by no means limited to applications employing a right angle receptacle, or contact header of the types described above.

Nor is the present invention limited to the lead frames designs, receptacle terminal configuration, or header pin layout disclosed herein. Further, the invention is not limited to connectors employing the specific pin counts (18×13 and 4×11) disclosed above. Accordingly, the scope of protection of the following claims is intended to encompass all embodiments incorporating the teachings of the present invention as defined in the claims.

What is claimed:

1. A plurality of substantially identical header modules capable of interacting with each other to form a header for mating with a receptacle, each substantially identical header module comprising:

a body having a substrate face for being mounted to a circuit substrate and an opposing mating face for being coupled to a mating connector thereat, the body defining at least one notch that extends thereinto and that extends from the substrate face substantially to the mating face;

at least one guide pin extending from said insulative body at the substrate face thereof in a direction substantially normal thereto; and a plurality of conductive pins passing through said insulative body in a direction substantially parallel to the guide pin, each of said conductive pins having a mating portion for engaging a contact on the mating connector and a tail for mounting the header module to the circuit substrate, wherein said guide pin of each substantially identical header module is adapted to engage a notch of an adjacent one of the substantially identical header modules and said notch of each substantially identical header module is adapted to receive a guide pin of an adjacent one of the substantially identical header modules, whereby adjacent ones of the substantially identical header modules may be mated to one another in a substantially seamless manner to at least partially form the header.

2. The header as recited in claim 1, wherein said plurality of conductive pins are arranged in a plurality of columns, with a first column aligned with a first edge of a corresponding conductive strip, and an adjacent second column aligned with a second edge of each of said conductive pins, said second edge being an opposite edge of said conductive strip with respect to said first edge.

3. The header as recited in claim 1, wherein said at least one notch is provided at a corner of said insulative body.

4. The header as recited in claim 1, further comprising a plurality of notches and a plurality of guide pins integrally formed within said insulative body.

5. The header as recited in claim 1, wherein said plurality of conductive pins are disposed in columns and at least three of said conductive pins are of unequal lengths.

6. The header as recited in claim 5, wherein said at least three conductive pins are disposed in said columns such that adjacent conductive pins in each of said columns have different lengths.

7. The header as recited in claim 1, wherein said header is adapted to be joined on a printed circuit board to at least one other header.

8. The header as recited in claim 7, wherein joined headers are mounted to opposing faces of the printed circuit board.

9. The header module as recited in claim 1, in combination with a receptacle, said receptacle comprising:

a frame; and a plurality of terminals extending through a first member of said frame and having a lead portion and a tail portion for mating the receptacle to another circuit substrate, wherein said plurality of terminals of said receptacle housing and said plurality of conductive pins of said header are adapted to be mated to each other to form a connector system, and wherein said lead portion of each of said plurality of terminals is separated by an air gap.

10. The header module as recited in claim 9, wherein said conductive pins are disposed in columns on said insulative body and at least two of said conductive pins in each of said columns have unequal lengths, wherein said at least two conductive pins being disposed in said columns such that adjacent conductive pins in each column have different lengths.

11. The header module as recited in claim 9, wherein said plurality of conductive pins and said plurality of terminals are arranged to have an interstitial ground pattern.

12. The header module as recited in claim 9, wherein a leading portion of each of said plurality of terminals is disposed within said receptacle, and a remaining portion of each of said plurality of terminals is external to said receptacle.

13. The header module as recited in claim 9, wherein said receptacle is adapted to mate with said header in accordance with a location of said guide pin.

14. The header module as recited in claim 13, comprising plural guide pins which provide for at least two points of guidance of said receptacle upon mating with said header.

15. The header module as recited in claim 13, further comprising a plurality of notches and a plurality of guide pins, said plurality of guide pins being aligned in a row, wherein said receptacle is adapted to mate in an orientation parallel to said row of guide pins.

16. The header module as recited in claim 15, comprising plural guide pins which provide for at least two diagonally opposed points of guidance of said receptacle upon mating with said header.

17. The header module as recited in claim 9, wherein said header comprises plurality of conductive pins arranged in parallel and said receptacle comprises a plurality of leads arranged in parallel, such that connections of signal leads and ground leads between first and second printed circuit boards connected by said connector follow substantially parallel paths through said connector assembly.

18. The header module as recited in claim 17, wherein an edge of one of said leads is arranged to be proximate to an edge of an adjacent lead, and wherein a distance separating edges in said connector assembly is less than a thickness of said leads.

19. A header assembly residing on opposing sides of a printed circuit board having at least one through hole, comprising:

a first header on one side of the printed circuit board and comprising:

a base; and a conductive pin extending from said base and having a tail mounted in the through hole; and a second header on an opposite side of the printed circuit board and comprising:

a base; and a conductive pin extending from said base and having a tail mounted in the through hole, said tails electrically connected to join said first and second headers, said tails overlapping one another within the through hole such that the tails extend past each other within the through hole.

* * * * *